US007377087B2

(12) United States Patent
Clarke et al.

(10) Patent No.: US 7,377,087 B2
(45) Date of Patent: May 27, 2008

(54) METHOD OF PRESERVING FOODSTUFFS

(75) Inventors: Brian D. Clarke, Bellingham, MA (US); Chuck Boulos, Milford, MA (US); John Chi Kin Mak, Wan Chai (HK)

(73) Assignee: Sunbeam Products. Inc., Boca Raton, FL (US)

( * ) Notice: Subject to any disclaimer, the term of this patent is extended or adjusted under 35 U.S.C. 154(b) by 52 days.

(21) Appl. No.: 11/506,473

(22) Filed: Aug. 18, 2006

(65) Prior Publication Data

US 2007/0039288 A1 Feb. 22, 2007

Related U.S. Application Data

(60) Provisional application No. 60/709,494, filed on Aug. 19, 2005.

(51) Int. Cl.
*B65B 31/08* (2006.01)
*B65B 51/10* (2006.01)

(52) U.S. Cl. ..... 53/434; 53/512; 53/469; 53/479; 83/639.3

(58) Field of Classification Search ..... 53/434, 53/512; 83/639.3
See application file for complete search history.

(56) References Cited

U.S. PATENT DOCUMENTS

| | | | | |
|---|---|---|---|---|
| 2,649,234 A | | 8/1953 | Taunton | |
| 2,778,173 A | | 1/1957 | Taunton | |
| 2,888,788 A | | 6/1959 | Gebhardt | |
| 2,896,385 A | * | 7/1959 | Gebhardt | 53/512 |
| 2,953,877 A | | 9/1960 | Chapman et al. | |
| 3,245,200 A | * | 4/1966 | Shaw | 53/512 |
| 3,815,464 A | * | 6/1974 | Frost | 83/639.3 |
| 3,980,226 A | | 9/1976 | Franz | |
| 4,534,154 A | | 8/1985 | Gaubert | |
| 4,920,726 A | * | 5/1990 | Yamada et al. | 53/512 |
| 4,923,701 A | | 5/1990 | VanErden | |
| 5,332,095 A | | 7/1994 | Wu | |

(Continued)

FOREIGN PATENT DOCUMENTS

DE 33 16 065 11/1984

(Continued)

OTHER PUBLICATIONS

Alipour—U.S. Appl. 60/643,183, filed Jan. 12, 2005.*

*Primary Examiner*—Stephen F. Gerrity
(74) *Attorney, Agent, or Firm*—Lawrence J. Shurupoff

(57) ABSTRACT

A method of preserving foodstuffs in a heat-sealable plastic bag wherein three of the bag's four peripheral edges are permanently sealed together and the fourth of the edges comprises a temporary interlocking linear seal. After foodstuffs are placed into the interior of the bag, the linear seal is interlocked to form an inner chamber and to isolate those foodstuffs therein from the outside environment. The bag is then pierced to provide an opening through which the inner chamber of the bag is evacuated. Then, while the inner chamber is evacuated, heat is applied to seal around the opening or between the opening and the portion of the inner chamber containing the foodstuffs to isolate the foodstuffs within said evacuated inner chamber from the outer environment. The foodstuffs may be removed from the bag by opening the interlocking seal and the bags may be reused numerous times by re-interlocking the seal and repeating the evacuating and sealing process.

22 Claims, 16 Drawing Sheets

U.S. PATENT DOCUMENTS

| | | | | |
|---|---|---|---|---|
| 5,433,061 | A * | 7/1995 | Hutchinson et al. | 53/434 |
| 5,544,752 | A | 8/1996 | Cox | |
| 5,598,684 | A * | 2/1997 | Aarts | 53/434 |
| 5,702,739 | A * | 12/1997 | Owensby | 53/434 |
| 5,839,582 | A | 11/1998 | Strong et al. | |
| 6,045,264 | A | 4/2000 | Miniea | |
| 6,244,023 | B1 * | 6/2001 | Lataix | 53/512 |
| 7,004,632 | B2 | 2/2006 | Hamilton et al. | |
| 2002/0191870 | A1 | 12/2002 | Richison et al. | |
| 2004/0000502 | A1 | 1/2004 | Shah et al. | |
| 2004/0000503 | A1 | 1/2004 | Shah et al. | |
| 2005/0044814 | A1 * | 3/2005 | Patterson et al. | 53/432 |
| 2006/0213148 | A1 | 9/2006 | Baptista | |
| 2006/0254219 | A1 * | 11/2006 | Alipour et al. | 53/434 |

FOREIGN PATENT DOCUMENTS

| | | |
|---|---|---|
| JP | 57 068323 | 4/1982 |

* cited by examiner

METHOD OF PRESERVING FOODSTUFFS

RELATED APPLICATION

This application is a Formalization and a Continuation-in-Part of U.S. Provisional Application Ser. No. 60/709,494 filed Aug. 19, 2005, the Specification and Drawings of which are incorporated herein by reference, in their entireties.

FIELD OF THE INVENTION

The present invention relates generally to packaging systems, and more particularly to method for vacuum sealing plastic bag type containers.

BACKGROUND OF THE INVENTION

Vacuum sealing appliances are used domestically and commercially to evacuate air from various containers such as plastic bags, reusable rigid plastic containers, or mason jars. These containers are often used for storing food. Vacuum sealing food packaging provides many benefits with a particular advantage of preserving the freshness and nutrients of food for a longer period of time than if food is stored while exposed to ambient air.

Typically, these appliances operate by receiving a bag, isolating the interior of the bag from ambient air, and drawing air from the interior of the bag before sealing it. One such appliance is a "Seal-A-Meal" product marketed by the Rival Company since at least 1982. This device utilized a simple nozzle to evacuate air from bags, while a single sealing door operated in conjunction with a heat-sealer to seal the bag closed. Other appliances have also been available to evacuate rigid containers such as jars.

A problem with these appliances is the necessity to seal the open end of the bag from the ambient air during the evacuation process. For this reason, many of these appliances use resilient foam sealing strips on the base and cover to isolate the opening of the bag from ambient air during sealing. However, such strips, which extend around the entire opening of the bag, make operation of the device cumbersome and require the use of a large device, which is longer than the open end of the bag.

Specifically, the resilient foam strips often interfere with the closing of the cover of sometimes making it difficult to securely fasten the cover in the closed position. Failure to securely close the cover permits ambient air to be drawn in during evacuation and prevents efficient operation of the device.

Accordingly, it would be desirable to provide a vacuum sealing device that is easy to close while sealing the open end of the bag from ambient air during evacuation.

Additionally, in order to completely surround and seal off the open end of the bag from the surrounding environment and to thereby deny the intake of outside air during the evacuation process, it is necessary for an appliance of the prior art to be significantly is longer than the open end of the bag. This results in the occupation of an undesirably large amount of kitchen shelf space and storage space for the appliance.

Accordingly, it would be desirable to provide a vacuum sealing device that is smaller in size, yet which may still be able to evacuate and seal full sized plastic bags.

Additionally, Such large appliances of the prior art generally include within their bodies a heavy vacuum pump, which becomes burdensome as the heavy body of the device must be moved towards the user for access.

It would therefore be desirable to provide such a vacuum sealing device in which only a lighter and less cumbersome portion of the device must be moved and lifted and the portion containing the heavy pump may remain in a base station position.

These and other objects and advantages of the present invention will become apparent to those skilled in the applicable art upon a review of the following description of the present invention, including drawings and detailed descriptions of several preferred embodiments thereof.

DETAILED DESCRIPTION OF THE PREFERRED EMBODIMENTS

Figure 1:
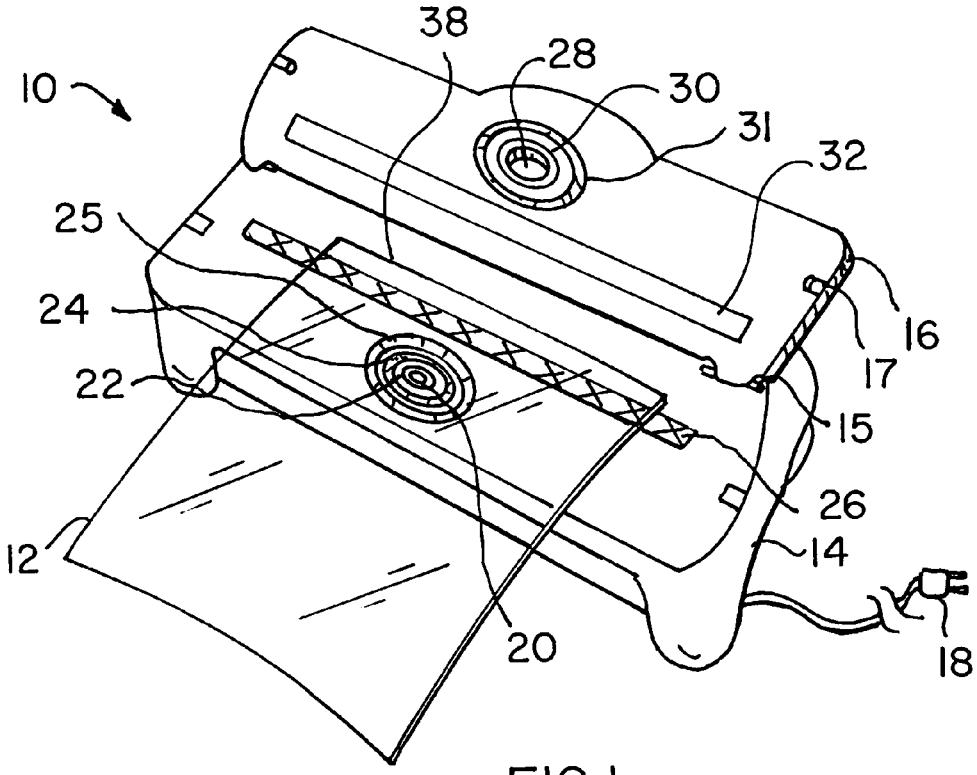
FIG. 1 is a top perspective view of a preferred counter-top embodiment of the vacuum sealing device formed in accordance with the present invention.

As shown in FIG. 1, this invention relates to a device 10 for vacuum packaging or vacuum sealing a bag 12. In the counter-top embodiment of FIGS. 1 through 12, the inner working components (e.g., the vacuum source and control system) of the device 10 are similar to that disclosed in U.S. Patent Publication No. 2005/0044814, the disclosure of which is incorporated herein by reference. In general, the vacuum sealing device 10 uses a vacuum source to extract air from a plastic bag 12 and seals the bag after the air has been extracted.

The vacuum sealing appliance 10 of the first counter-top embodiment, shown in FIG. 1, generally consists of a base housing 14 and a cover 16. The cover 16 is pivotally connected to the base 14 about a hinge 15 and can be secured to the base by a latch mechanism 17.

The base housing 14 is designed to contain the vacuum source and the control system therein for the entire vacuum sealing system, which is powered by a power assembly consisting of an AC power cord 18 leading from the base housing and is connectable to an AC outlet. It is also conceivable for the device to be battery operated. The vacuum source located within the base housing is preferably a vacuum pump (not shown) including an electric motor, a motor fan blade and a pump cylinder. Again, these components are described in U.S. Patent Publication No. 2005/0044814.

The vacuum source is in fluid communication with a vacuum nozzle 20 movably disposed within an annular nozzle chamber 22 formed in the base housing 14. Surrounding the annular nozzle chamber 22 is a heat-sealing ring 24 and surrounding the heat-sealing ring is a resilient foam ring 25. The base housing 14 further includes a heat-sealing strip 26 spaced inwardly from the heat-sealing ring 24.

The cover 16 includes a circular nozzle recess 28 surrounded by an annular backing ring 30 and an annular foam ring 31. The cover 16 further includes a longitudinal backing strip 32 disposed inwardly from the recess 28. When the cover 16 is closed on the base housing 14, the backing ring 30, the resilient foam ring 31 and the backing strip 32 respectively align with the heat-sealing ring 24, the resilient foam ring 25 and heat-sealing strip 26 of the base housing 14. As will be described in further detail below, the circular nozzle recess 28 of the cover 16 provides clearance for the vacuum nozzle 20 disposed within the base housing 14.

As shown in FIGS. 3-7, the vacuum nozzle 20 is a generally tubular element terminating at a sharp edge to form a bag puncturing blade 34. The periphery of the nozzle 20 is formed with a plurality of vacuum ports 36 through which air is evacuated from the bag 12.

Figure 2:
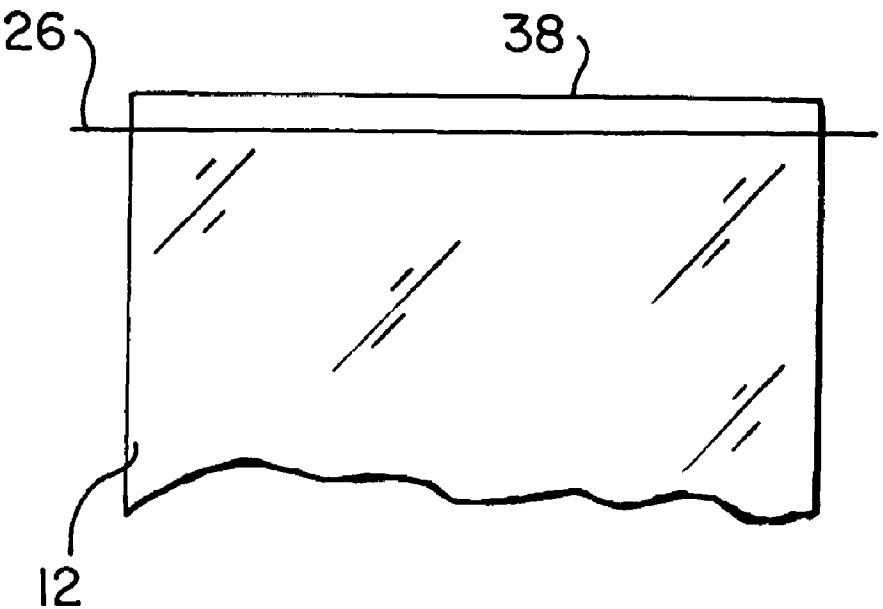
FIG. 2 is a schematic top view of the first step of a bag being sealed with the vacuum sealing device formed in accordance with the present invention.
Figure 5:
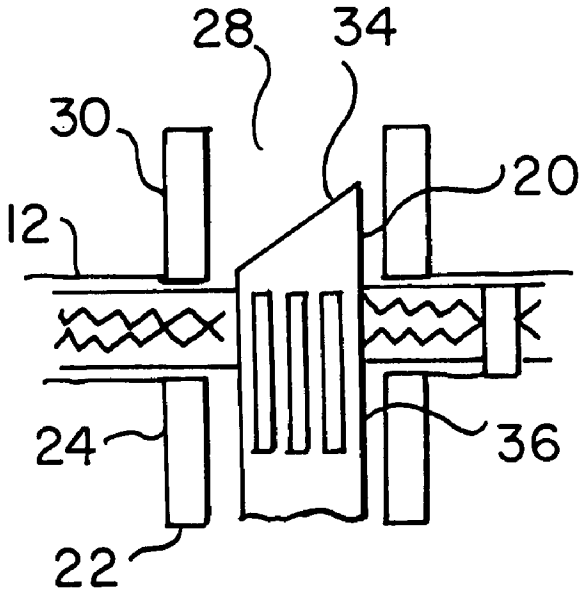
FIG. 5 is a schematic cross-sectional view of the second sealing step shown in FIG. 4.
Figure 4:
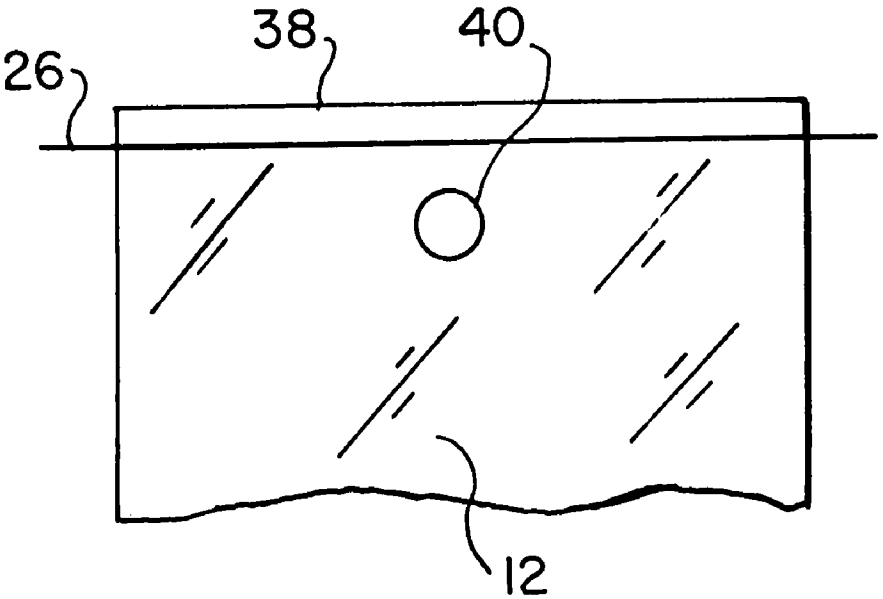
FIG. 4 is a schematic top view of the second step of a bag being sealed with the vacuum sealing device formed in accordance with the present invention.
Figure 7:
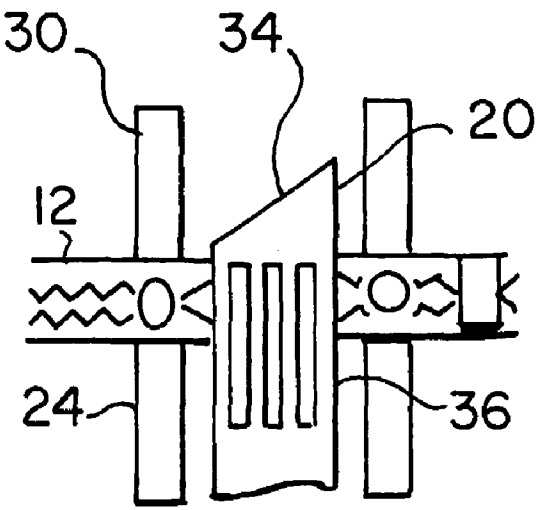
FIG. 7 is a schematic cross-sectional view of the final sealing step shown in FIG. 6.
Figure 6:
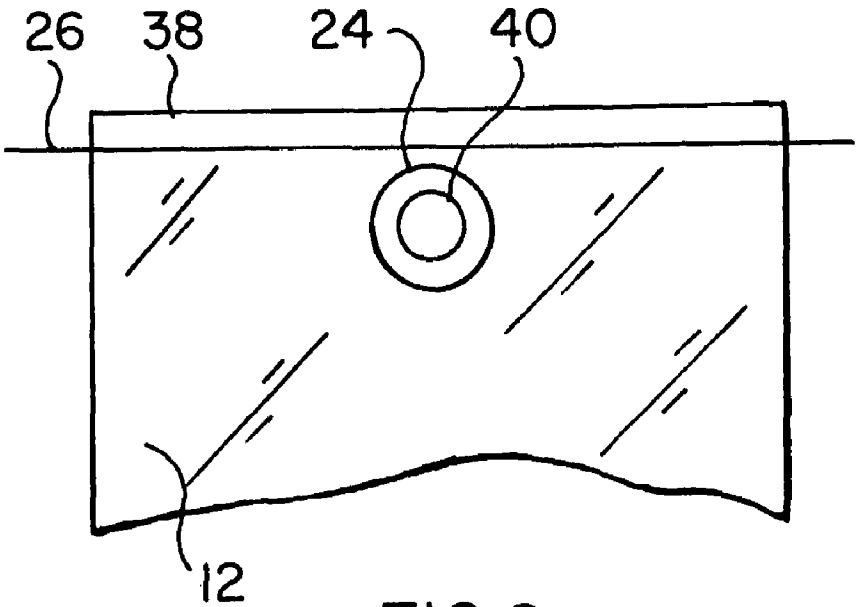
FIG. 6 is a schematic top view of the final step of a bag being sealed with the vacuum sealing device formed in accordance with the present invention.

In operation, a bag is placed on the base housing 14 so that its open end 38 is positioned adjacent the heating strip 26, as shown in FIGS. 1 and 2. The bag 12 is first heat-sealed closed by closing the cover 16 onto the base housing 14 and activating the heating strip 26. During the initial heat-sealing, the vacuum nozzle 20 is retracted within the nozzle chamber 22 of the base housing 14. Once the bag 12 is sealed, the vacuum nozzle 20 is brought upward into contact with the bag so that the nozzle blade 34 punctures a hole 40 in the bag, as shown in FIGS. 4 and 5. With the nozzle 20 held in this position, the vacuum source is activated and air is evacuated from within the bag through the vacuum ports 36 formed in the nozzle 20. During the evacuation process, the resilient foam ring 25 of the base is compressed against the resilient foam ring 31 of the cover to isolate the nozzle 20 from ambient air. Once all the air is evacuated, the heat-sealing ring 24 surrounding the hole 40 punctured by the nozzle 20 is activated to form a heat-seal ring, as shown in FIGS. 6 and 7.

In this embodiment, the nozzle 20 is described as being movable with respect to the base 14. However, it is conceivable for the nozzle 20 to remain in a fixed extended position with respect to the base 14. In this case, a bag 12 is placed over the nozzle 20, wherein the nozzle pierces the bag as the cover 16 is closed. Heat-sealing and air evacuation then proceed as described above.

The heating ring 24 and heating strip 26 are preferably made up of heating wires, as described in U.S. Patent Publication No. 2005/0044814, to melt the portions of the plastic bag 12 that it comes into contact with The heating wires may be in communication with a pressure sensor and a timing circuit of the control system to coordinate operation of the heating strip 26 and the heating ring 24. Specifically, a pressure sensor may be utilized to detect closure of the cover 16 and to activate the heating strip 26 in response thereto. The timing circuit may then terminate power to the heating strip 26 after a predetermined period of time that is sufficient for sealing to occur, and then signal the nozzle 20 to extend. The control system may further include a vacuum sensor in communication with the vacuum nozzle 20 to detect when the air has been evacuated from the bag and to trigger the heating ring 24 in response thereto. A second timing circuit can be utilized to terminate power to the heating ring 24 and to retract the nozzle 20. Of course, such operation can be done manually, by requiring the user to momentarily depress and release respective switches to activate the heating wires and vacuum nozzle. Upon completion of this process, the plastic bag 12 is removed, resulting in a plastic bag with airtight seals.

Figure 1A:
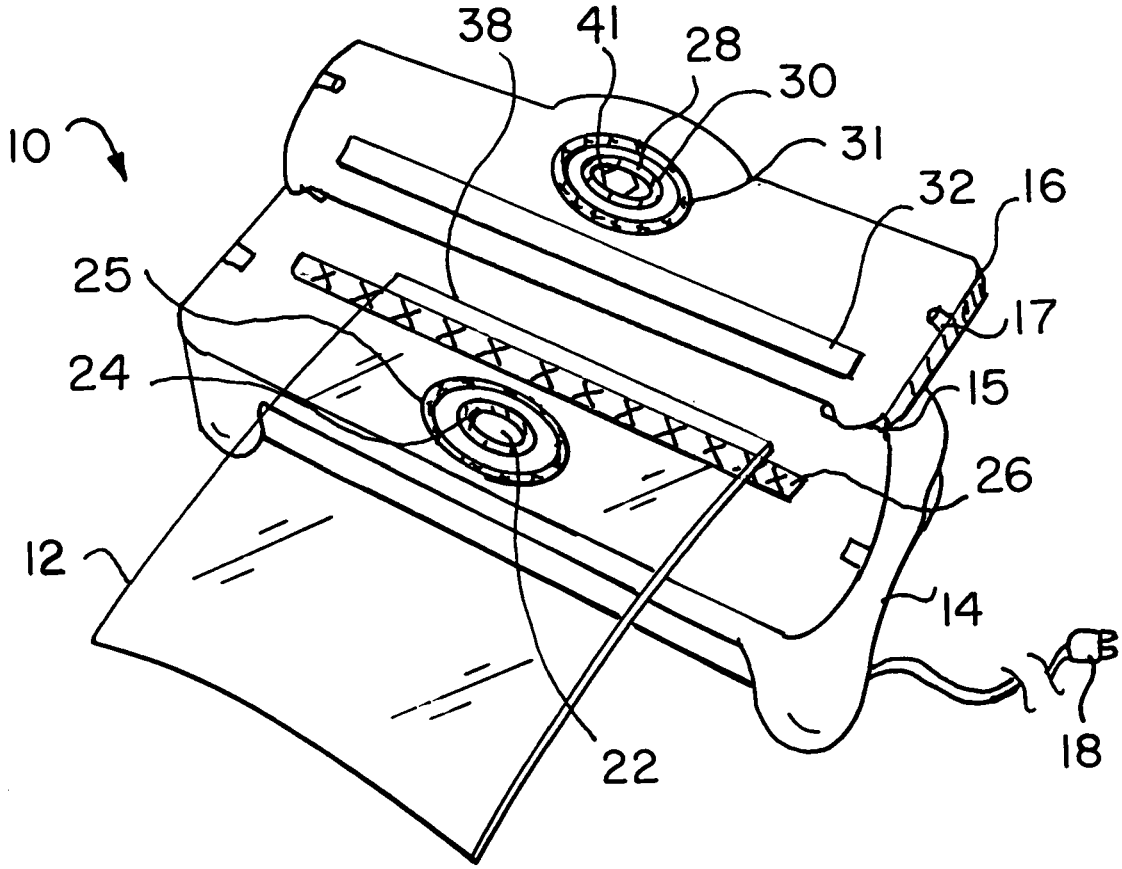
FIG. 1A is a top perspective view of another preferred counter-top embodiment of the vacuum sealing device formed in accordance with the present invention.
Figure 1B:
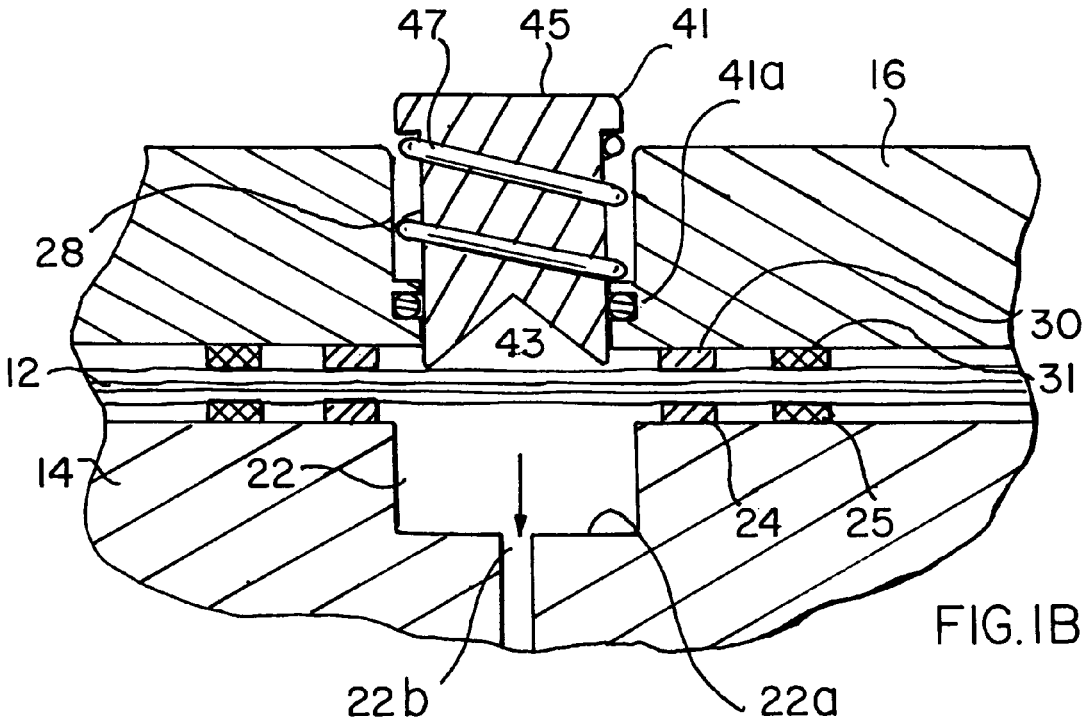
FIG. 1B is a schematic cross-sectional view of the sealing device shown in FIG. 1A.

In an alternative counter-top embodiment shown in FIGS. 1A and 1B, the cover 16 includes a device for creating a hole on the bag such as a punch 41 movably disposed within the recess 28 of the cover 16. In this embodiment, the air is evacuated through the base. Chamber 22 includes a bottom wall 22*a* having a port 22*b* that is in fluid communication with the vacuum pump located in the base 14. The punch 41 may include a round cylindrical device having points 43 at its distal end. The punch 41 is translatable within the cover 16 and may be operably connected to an actuation member 45 extending upwardly from the top of the cover 16. The actuating member 45 may be the upper end of the punch 41. A user may push down on the actuation member 45 to move the punch 41. In an alternative embodiment, the operation of the punch may be automated and operated by a linear motor, solenoid or other electrical or electro-mechanical device. A sealing device 41*a* may be included to seal between the punch and the cover so that air is not drawn in from around the punch. The sealing device may be an o-ring or other suitable gasket material. Also, the punch 43 is preferably biased in an upward retracted position by a spring 47. As described with respect to the embodiment shown in FIG. 1, the cover recess is further surrounded by the backing ring 30 and the resilient foam ring 31 in order to seal out ambient air.

In operation with the cover 16 closed, a user may push the actuation member 45 down forcing the punch 41 to pierce the bag 12. Upon releasing the actuation member 45, the spring 47 returns the punch 41 to its initial position. At this point, the vacuum pump is activated, thereby permitting the air in the bag 12 to be evacuated via the port 22*b*. As the air is being evacuated, the resilient foam rings 25 and 31 seal the opening of the bag from ambient air. After the evacuation of the air from the bag is completed, the heating element 24 is activated to heat-seal the bag opening, as described above.

Figure 1C:
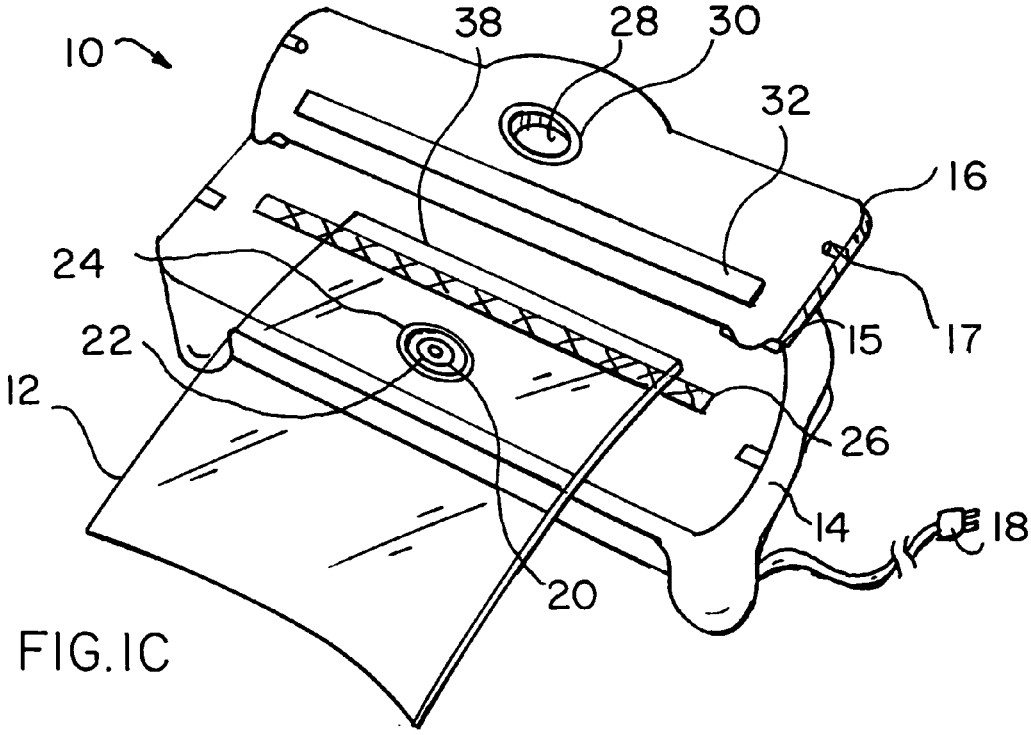
FIG. 1C is a top perspective view of another preferred counter-top embodiment of the vacuum sealing device formed in accordance with the present invention.
Figure 3:
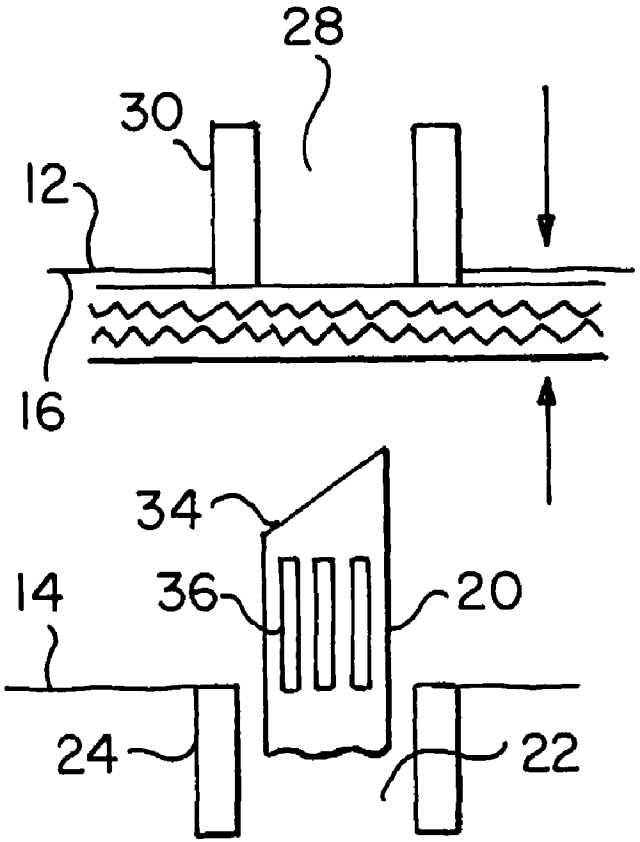
FIG. 3 is a schematic cross-sectional view of the first sealing step shown in FIG. 2.

In a preferred counter-top embodiment, as shown in FIG. 1C, the sealing between the heat-sealing ring 24 and the annular backing ring 30 is sufficient to isolate the nozzle 20 from ambient air, when the cover 16 is closed. In other words, it is preferred to design the heat-sealing ring 24 and the annular backing ring to provide an air-tight seal therebetween when the rings are compressed against each other. In this case, the resilient foam ring 25 and the opposing annular foam ring 31 shown in FIGS. 1, 1A and 1B can be eliminated. Thus, the amount of resilient foam required for isolating the opening of the bag from ambient air is further minimized.

Figure 8:
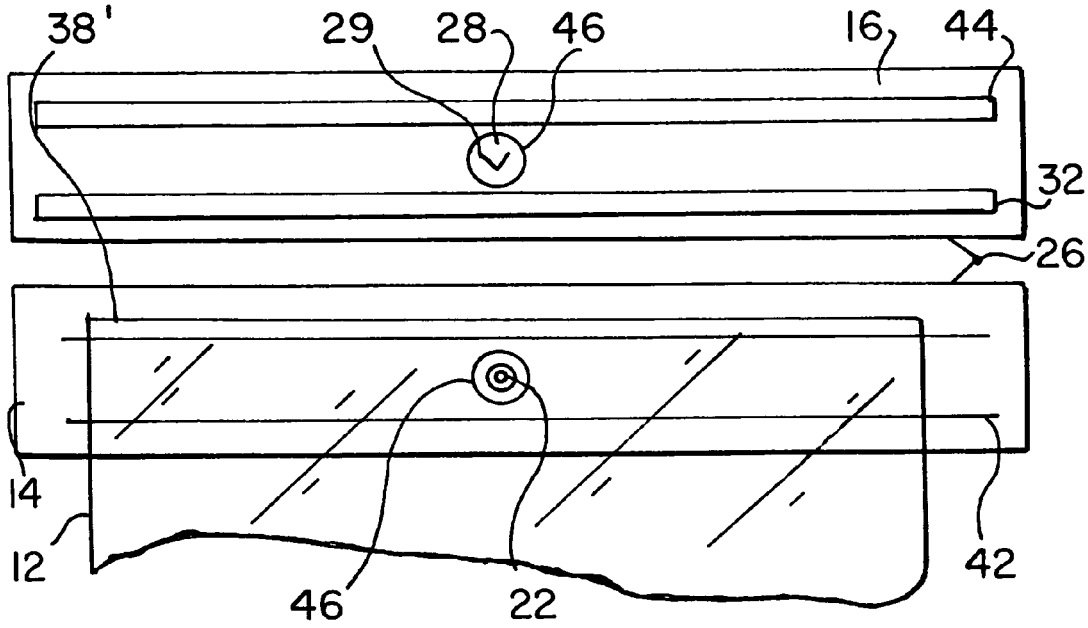
FIG. 8 is a schematic top view of an alternative counter-top embodiment of the present invention.

In another alternative counter-top embodiment, as shown in FIG. 8, the heat-sealing ring 24 is replaced with a second heat-sealing strip 42 disposed outwardly from the first heat-sealing strip 26. In particular, the base housing 14 includes two heat-sealing strips 26 and 42 that operate in sequence to seal a plastic bag 12 and a vacuum chamber 22 disposed between the two heat-sealing strips. Here too, the cover 16 preferably includes rubber heat backing strips 32 and 44 positioned opposite the respective heat strips 26 and 42 when the cover 16 is closed to provide a surface to heat-seal the bag 12 against. Also, in this embodiment, surrounding the vacuum chamber 22 in the base housing 14 and surrounding the cover recess 28 in the cover 16 is a resilient vacuum seal foam gasket 46. As described above, these gaskets 46 provide an air-tight seal around the nozzle 20 so that only air within the bag 12 is sucked in through the nozzle.

In this embodiment, the cover 16 includes a v-shaped blade 29 disposed in the cover recess 28. The blade 29 can be fixed so that it punctures the bag 12 when the cover 16 is closed or it can be mounted on a flexible diaphragm (not shown) to allow it to be retracted when not in use. Also, the blade 29 can be pushed down to puncture the bag 12 by a 'button' extending above the cover 16, as described above.

The vacuum chamber 22 below the blade 29 serves as an area for the blade to enter and is in fluid communication with the vacuum pump so as to provide a conduit for the evacuated air to pass through. In this case, there is no nozzle needed since the v-shaped blade 29 pierces the bag 12 making a v-shaped cut in the bag. This creates a v-shaped 'flap' (between the opposing v-sides of the blade) in the bag material that can flex to allow a passage of the evacuated air out of the bag. The blade 29 can stay in place, in the pierced bag 12, and still allow air to pass out through the cut In use, a bag 12 is placed on the base housing 14 with its open end positioned adjacent the first heating strip 26, as described above. The cover 16 is closed to clamp the bag 12 in the device and to pierce 3 the bag with the blade 29. The first heating strip 26, which extends along the length of the bag, is then activated to seal the open end 38 of the bag. Once the bag 12 is sealed, the vacuum source is activated to evacuate air from the bag via the chamber 22. After the air is evacuated from the bag 12, the second heating strip 42 is activated to form a seal across the width of the bag that isolates the hole punctured by the blade 29 from the content holding portion of the bag.

Figure 9:
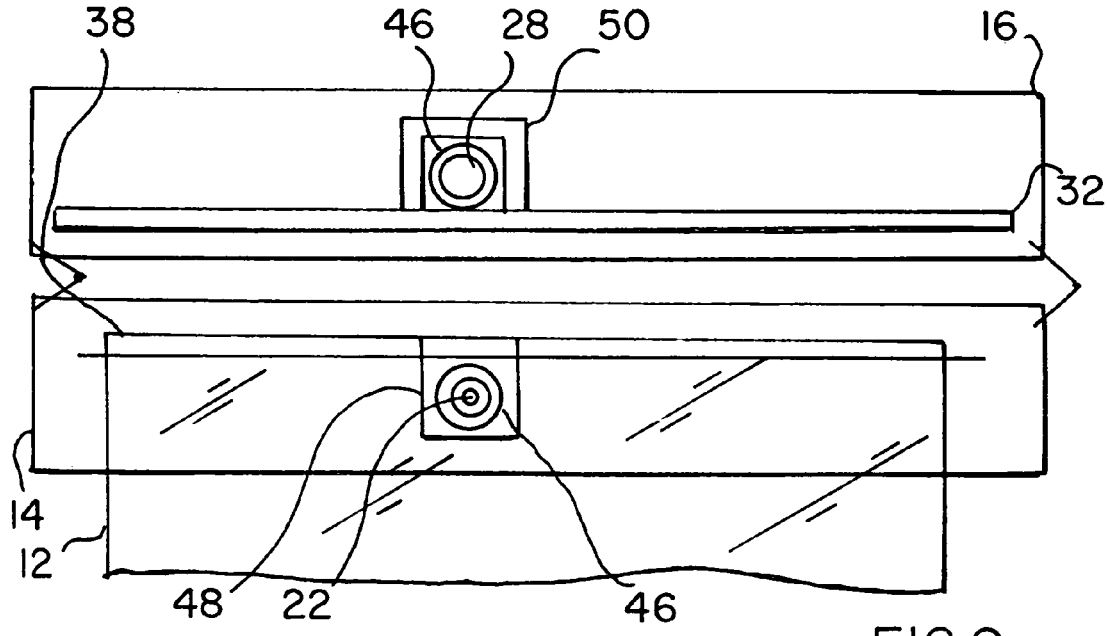
FIG. 9 is a schematic top view of another alternative counter-top embodiment of the present invention.

In a further alternative counter-top embodiment shown in FIG. 9, a first heating strip 26 extends along a width of the base 14. A second U-Shaped heat-sealing strip 48 is provided around three sides of the vacuum chamber 22 to perform the second heat-seal. The cover 16 preferably includes resilient heat backing strips 32 and 50 positioned opposite the respective heat strips 26 and 48 when the cover is closed to provide a surface to heat-seal the bag 12 against.

In operation, a bag 12 is inserted onto the base 14 with the open end extending past the first heating strip 26. The cover 16 is then moved to a closed position. A latch mechanism (not shown) may be used to hold the cover in the closed position. The pressure of the resilient strips urges the bag against the heating strips, and thereby holding the bag in place. A user may then initiate the sealing and vacuum process by, for example, pushing a button. The first heating strip 26 is energized for a predetermined period of time, sufficient to seal the open end of the bag from ambient. A punch or a vacuum nozzle may then extend either by manual actuation by the user or automatically by operation of a linear motor to punch through the bag creating a relatively small opening. This opening is sealed from ambient air by resilient material form a gasket 46 surrounding the nozzle. The vacuum pump is then initiated to evacuate the air from the bag. When the desired amount of air is evacuated, the vacuum pump shuts off and the second heating strip is energized, thereby sealing off the opening from the contents holding portion of the bag. Alternatively, the vacuum pump may keep running while the second heating strip is energized and shuts off only after the second sealing process is completed. The cover may then be opened to release the vacuum sealed bag.

Figure 11:
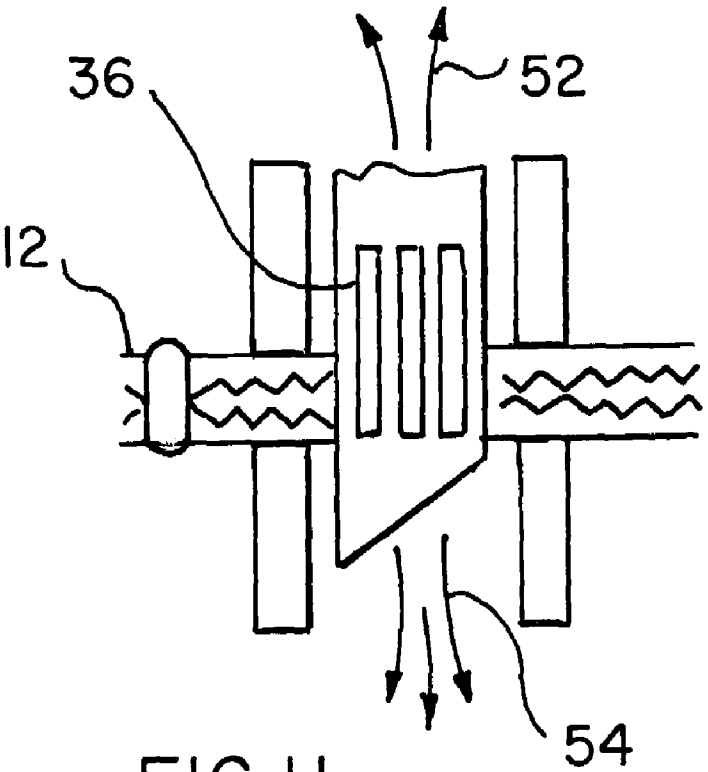
FIG. 11 is a schematic cross-sectional view of the embodiment of FIG. 10 showing the cover in its closed position.
Figure 10:
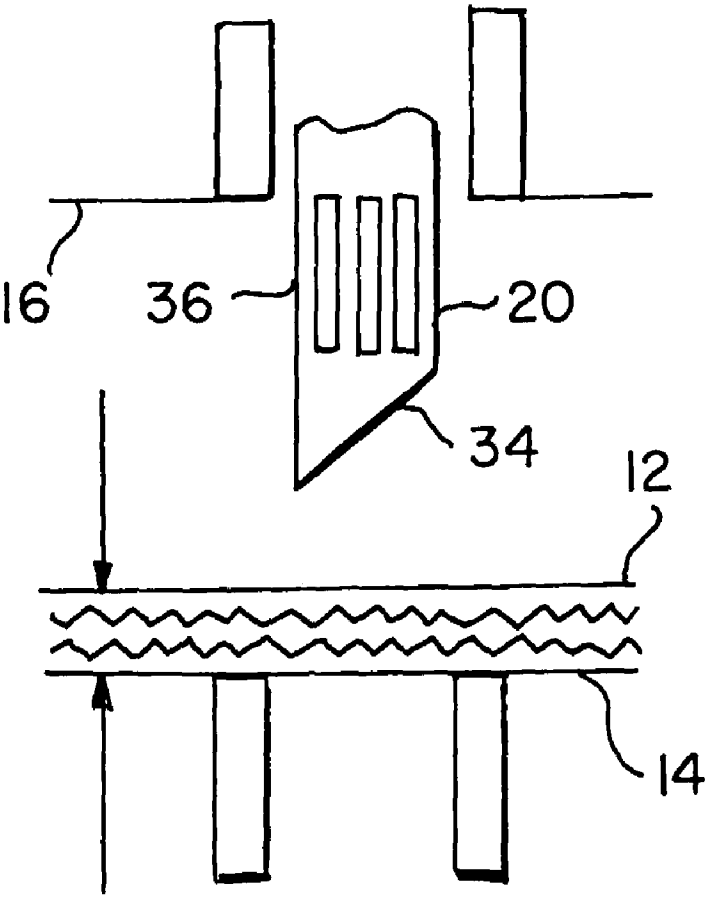
FIG. 10 is a schematic cross-sectional view of another alternative embodiment of the present invention showing the cover in its open position.

The nozzle 20, if provided, has thus far been described as being disposed in the base 14. However, it is further conceivable for the nozzle to be disposed in the cover 16, as shown in FIGS. 10 and 11. Again, the nozzle 20 may be extendable and retractable with respect to the cover 16 or it may be fixed in an extended position so that upon closure of the cover, the nozzle pierces the bag 12. Also, the nozzle 20 may be in communication with the vacuum source disposed within the base 14 via a tube (not shown) which runs in the cover 16 to the base. In this case, air will be evacuated from the bag 12 in the direction of the arrows 52 shown in FIG. 11. Alternatively, the vacuum source disposed in the base 14 may draw air from the open end 34 of the nozzle 20 through the nozzle slits 36 12 in the direction of the arrows 54 shown in FIG. 11.

Figure 12:
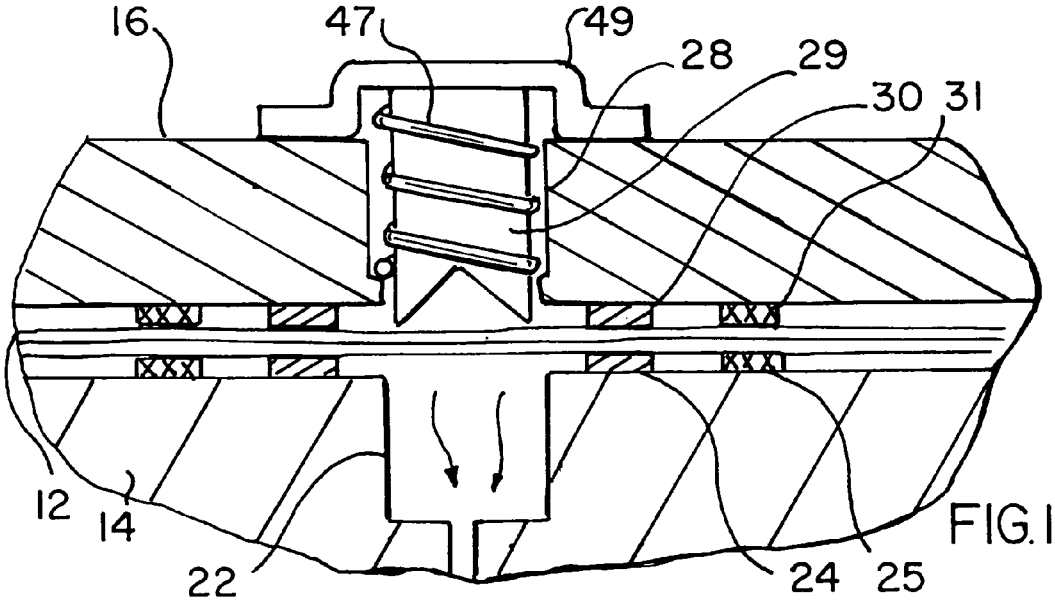
FIG. 12 is a schematic cross-sectional view of still another alternative embodiment of the present invention.

FIG. 12 shows another alternative counter-top embodiment, wherein a punch blade 29 can be mounted in the cover recess 28 along with a flexible diaphragm 49. The diaphragm 49 seals the cover recess and can be manipulated by the vacuum system so there is no requirement for the user to press anything to puncture the bag 12. This can be achieved by applying a vacuum directly in the cover recess 28 or indirectly via the vacuum chamber 22. As the initial vacuum starts to be drawn between the diaphragm 49 and the surface of the bag 12, the diaphragm would move toward the bag, pulling the blade 29 into contact with the bag and puncturing it. The diaphragm arrangement avoids the use of o-rings to seal the moveable blade and associated leaks at the o-rings.

On a manually extended blade (push button), the blade button could also incorporate an electrical switch so that pressing the spring loaded "button" mechanically punctures the bag as well as activates the electronics and vacuum pump.

In still another alternative counter-top embodiment, the width of the bag can be sealed in a separate operation independent of the puncture and evacuation of the bag. The bag would be placed into the sealer, sealed closed and then relocated into a separate punching area. The punch could be positioned at the corner of the bag to allow more useable space in the bag; i.e. the margin between the bag contents and the seal would not have to be so wide as to accommodate the punch seal rings, allowing less bag waste and easier positioning of the bag in the sealer. This would also reduce the force necessary to initially seal the bag as the seals necessary for the punch and evacuation are done in a separate process to the sealing of the width of the bag.

Moreover, instead of the bag being sealed across the entire width of the opening at one time (requiring the entire mouth of the bag to be inserted into the 'sealer'), the bag could be fed into a device (distantly resembling a power letter opener) that would pull the bag through drive rollers and seal the bag 'sequentially' in linear fashion along the width of the opening as the bag passed through. This could be accomplished by passing the bag between a heated roller with a raised flange and unheated drive roller(s), or in another iteration; unheated drive rollers with a heated pressure plate located between them. After the bag was sealed the corner of the bag would be inserted into a separate punch area where the bag is punched, evacuated and the punch hole sealed. This allows bags of any width to be sealed and evacuated (clothing storage, large items, etc.), allows the sealer itself to be much smaller in size as its size is not dictated by the width of the bag, and significantly reduces gasket sealing force issues as the only gasket used is around the punch.

In all of the above described embodiments, the amount of resilient foam required for isolating the opening of the bag from ambient air is limited to the small area surrounding the nozzle. As a result, the cover of the device can be easily closed on the base without too much interference or resistance.

Two alternative hand-held preferred embodiments are next shown in FIGS. 13 through 16. These versions of the invention have numerous advantages over countertop models. Most notably, they enable vacuum sealing of full-size bags with a device that is much smaller than the length of the openable end of the bag, so that the portion of the device with which the user interfaces may be much smaller than a countertop model, and they omit the heavy pump, controller, or other features from the portion of the device with which the user interfaces, so that may be much lighter and easier to use.

Figure 13:
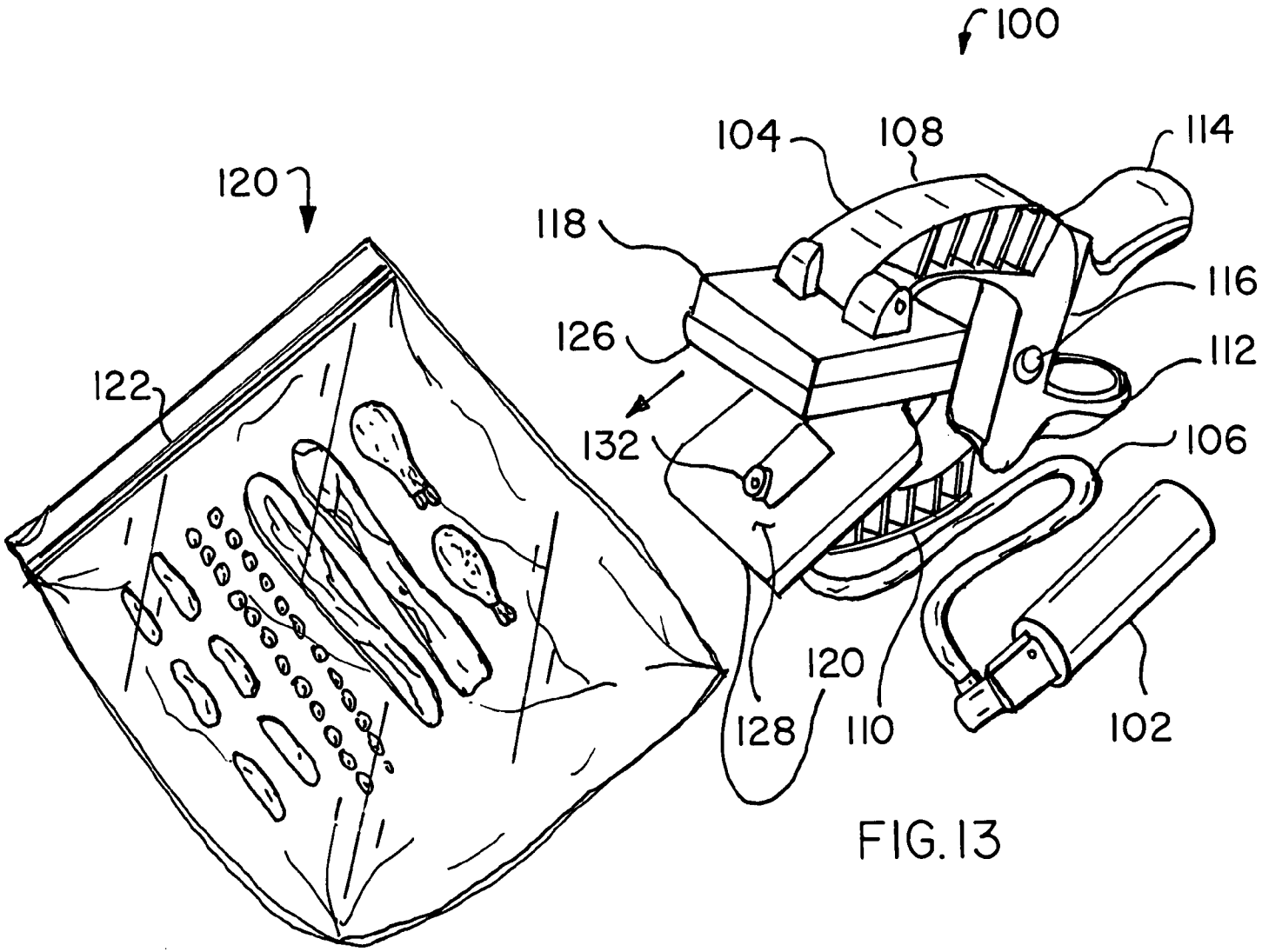
FIG. 13 is a perspective view of another preferred hand-held embodiment of a vacuum sealing device formed in accordance with the present invention just about to engage a food-filled plastic bag.
Figure 14:
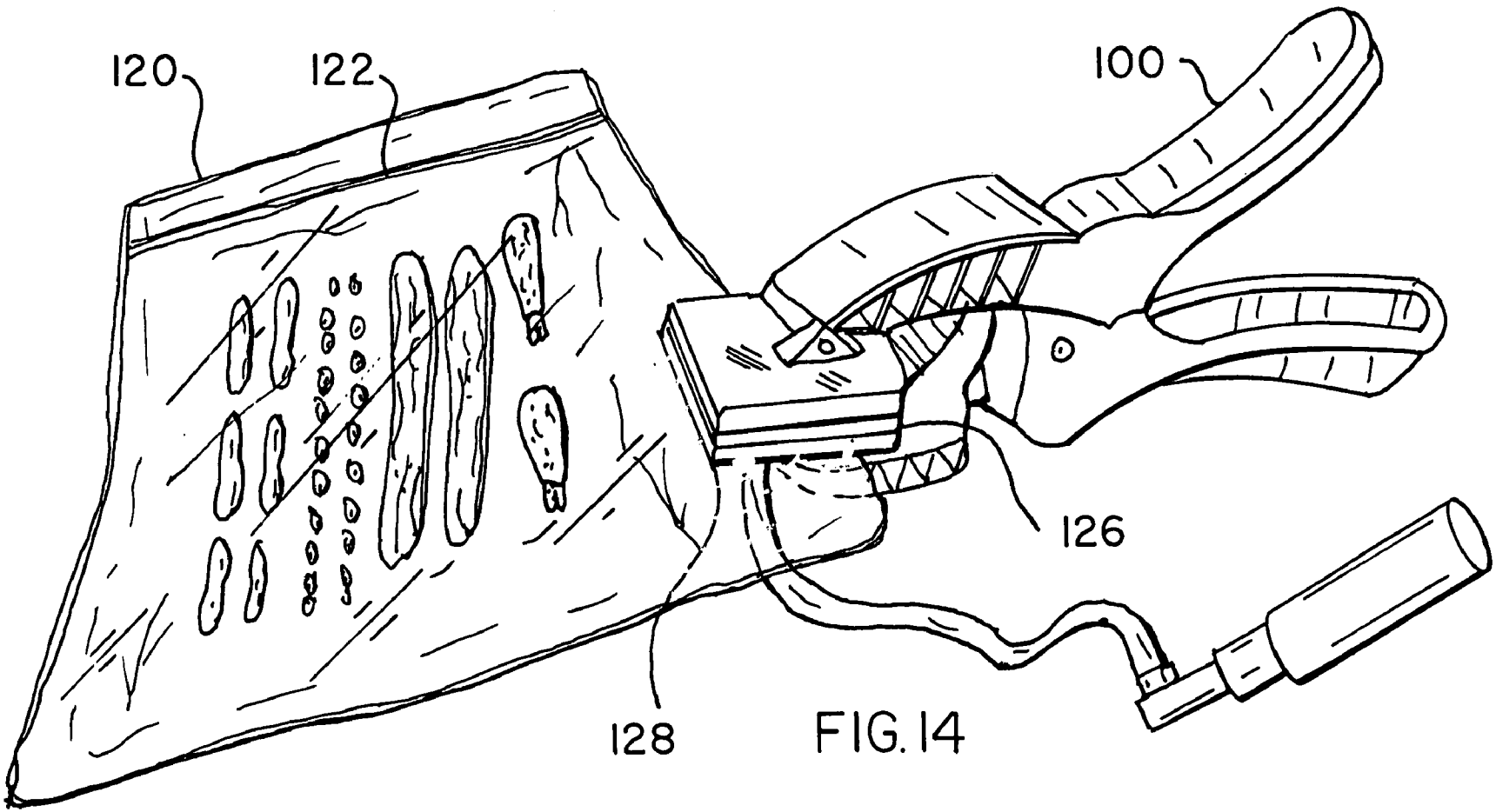
FIG. 14 is a perspective view of the hand-held embodiment and bag of FIG. 13 during the process of vacuum-sealing the bag.

Referring to the first hand-held embodiment of FIGS. 13 and 14, vacuum sealing apparatus 100 is used in conjunction with a plastic bag 120 having a temporarily interlocking linear hermetic seal 122. The apparatus 100 takes the form of a base station 102 umbilically connected through cord 106 to a remotely-operable clip 104 having normally closed upper and lower jaws 108 and 110, respectively, which are actuated by integrally formed lower and upper handles 112 and 114, respectively, about hinge 116 and against the force of an internal spring (not shown) to separate upper and lower sealing plates, 118 and 120, respectively, for thereby receiving a peripheral edge of the already food-filled and sealed bag 120. Upon release of the handles, the sealing plates, being biased towards a closed position, clamp onto the edge of the bag in preparation for puncturing, evacuating, and sealing the bag, according to the later-described process.

In this case, the temporarily interlocking linear hermetic sealing of the open end of the bag is accomplished by a well-known temporary linear seal 122. The panels of the bag incorporate interlocking strips which extend across the entire open end of the bag and allow the bag to be hermetically sealed, re-opened, and temporarily resealed numerous times. The specific details of such a seal are beyond the scope of this invention and will not be fully described herein except to say that virtually any of the many versions of such seals from the prior art could be used in this invention to achieve the desired result of temporarily hermetically sealing the openable end of the bag while allowing re-opening and temporary re-sealing numerous times.

Plastic bags having such linear interlocking seals have been in use in the marketplace for many years. Such self-sealing bags are flexible and disposable and both reliable and inexpensive to manufacture, and are very familiar to those skilled in the art of manufacturing and using plastic bags. Conventional plastic food storage bags employing such interlocking seals include those sold under the trademark Ziplock™. Such self-sealing bags are shown and described in numerous patents, including U.S. Pat. No. 4,923,701.

Such interlocking strips are generally disposed along and adjacent to the open peripheral edges of the bag panels, as they are herein, and commonly include mateable male and female, or tongue and groove portions which interlock to close the open end of the bag and isolate the food within the bag from the air outside the bag.

Typical among the numerous prior art versions of such temporarily interlocking linear hermetic sealable bags, once food is placed in the bag, the male and female strips are oriented, engaged, and pressed shut by applying continuous compression across the strips with the fingers or a slide mechanism.

Such seals are adapted to allow the user to unseal and reopen the bag by simply peeling the panels apart along the seal, and to reclose and reseal the bag numerous times.

As previously stated, such interlocking strips are not, in and of themselves, within the scope of this invention. However, their use in a system that creates a hole through the bag separate from the bag's openable end after food has been inserted and the interlocking strip has been closed, evacuates the bag through that hole, and which then permanently heat-seals the bag around that hole and apart from the interlocking seal, while allowing for repeated uses of the bag though the openable end, is one of the major aspects of the invention common among the handheld embodiments hereafter described. The most notable advantage of such a system being that it allows for a small and lightweight device for ease of use and minimal occupation of valuable kitchen counter space.

Excepting for the use of such interlocking seals and excepting that the devices of FIGS. 13 through 17 are "hand-held" and thereby comprise a different arrangement of their components than those countertop embodiments previously described, the methodology and functionality of the piercing, evacuating, and heat-sealing of food-filled plastic bags is similar in the hand-held embodiments to the afore-described, so only those features distinct to the hand-held embodiments are heretofore described.

Referring again to FIGS. 13 and 14, base station 102 includes a vacuum pump and control circuitry similar to those employed within the previously described countertop embodiments of the invention. The base station may be energized via a battery or direct connection to an AC power source, such as a typical 120 VAC plug.

Cord 106 comprises an air hose and electrical wiring (neither shown) which connect clip 104 both electrically and pneumatically to the base station. It can be appreciated that the base station may thus be positioned remotely from the point of use of the clip, which is advantageous in that the base station, which might be of any size, weight and shape, may remain at, for instance, the back of the kitchen counter and out of the way during use, and does not need to be lifter and brought to the bag being vacuum-sealed.

Clip 104 comprises upper sealing plate 118, which is electrically and pneumatically inert, and simply comprises an upper flat square rubber-type peripheral seal 126 against which an identical lower flat square rubber-type seal 128 of lower sealing plate 120 is pressed by the closing bias of the clip about hinge 116. When the clip engages an edge of a food-filled bag as shown in FIG. 14 and is allowed to close and clamp onto the edge, the panels of the bag at that edge become firmly sandwiched between the sealing plates and isolated from the outside air via rubber-type seals 126 and 128.

Once the bag has been so clamped, piercing/vacuuming element 132 is activated to pierce a hole (not shown) though the panels of the bag and to evacuate the bag though that hole using any one of the piercing and evacuating methods described in the previous embodiments. Lower rubber seal 128 comprises an annular heat-sealing element for heal-sealing around the hole as described in the previous embodiments.

Figure 15:
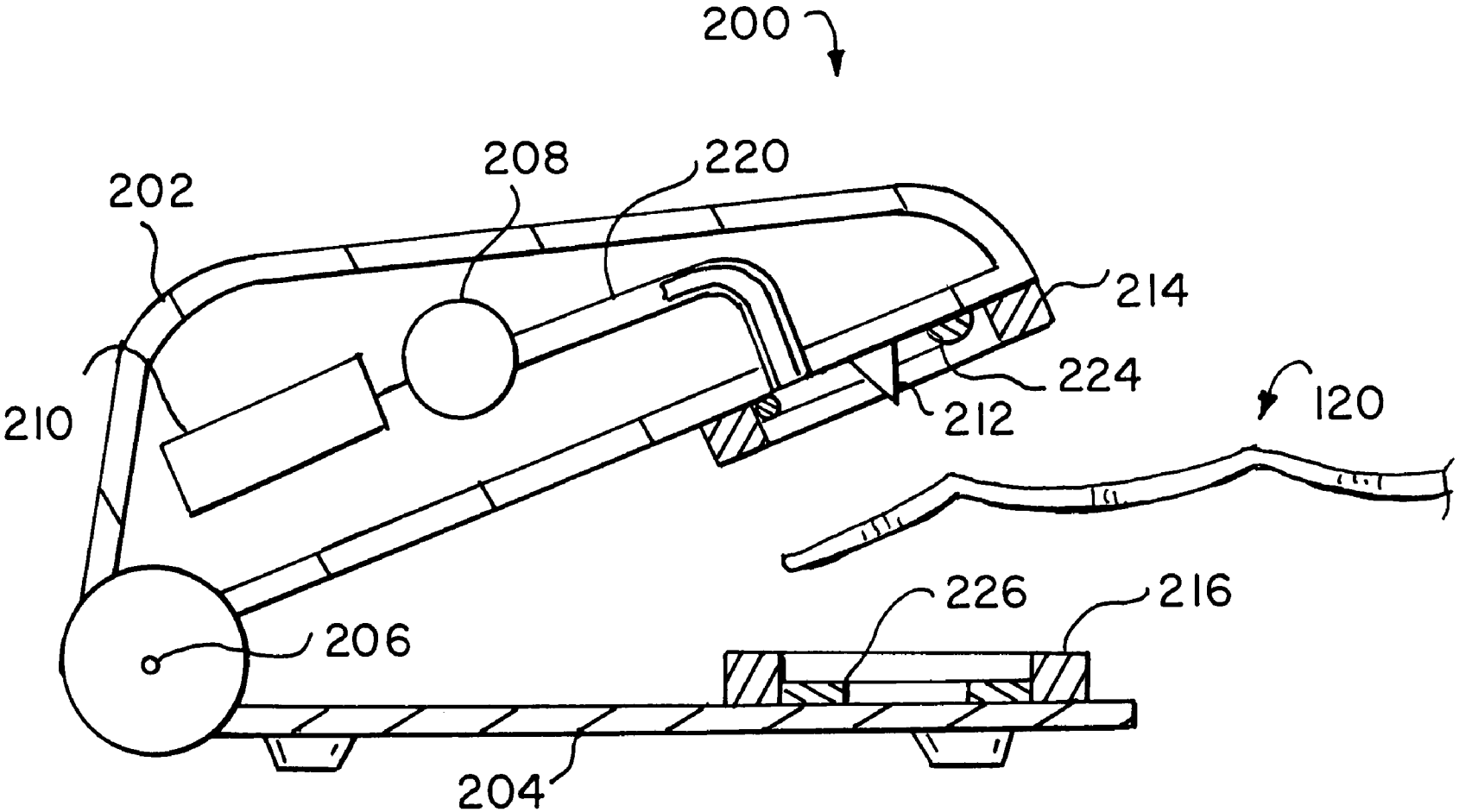
FIG. 15 is a cross-sectional side view of another preferred hand-held embodiment of a vacuum sealing device formed in accordance with the present invention just about to engage a plastic bag.
Figure 16:
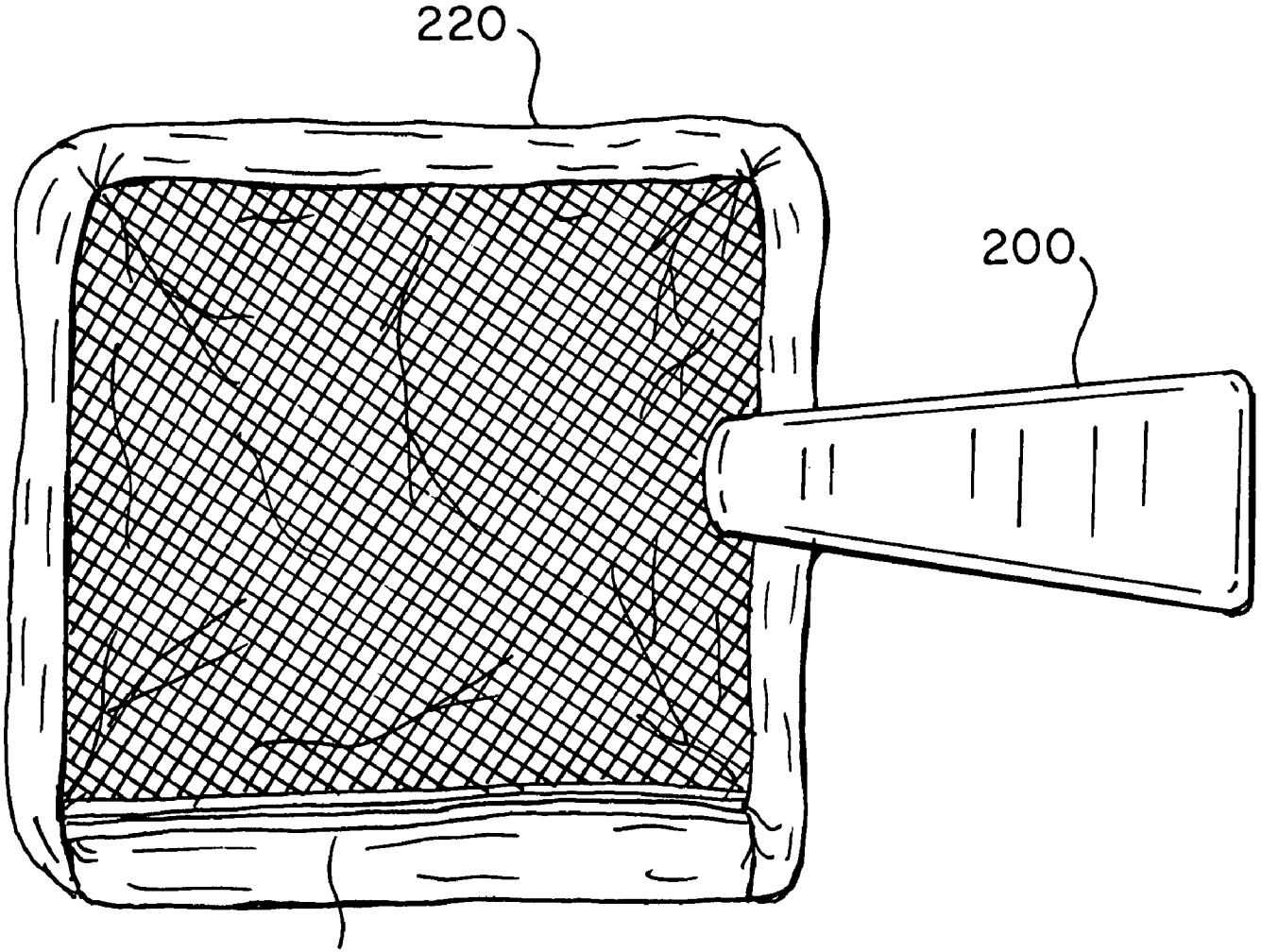
FIG. 16 is a top view of the hand-held embodiment and bag of FIG. 15.

Referring to FIGS. 15 and 16, a second hand-held embodiment 200 is shown in having an upper housing 202 connected to a base 204 via a hinge 206. The upper housing and base are biased together and into a closed position by a spring (not shown), so that they may be pulled open to engage a peripheral edge of a food-filled bag having a temporarily interlocked seal 222, just as in the previous embodiment, and may then be allowed to close upon and clamp onto that peripheral edge to perform a similar piercing, evacuating, and heat-sealing operation.

Housing 202 comprises a vacuum pump 208 and an electrical control circuit 210. Piercing blade 212 punches a hole (not shown) through both of the bag panels as the housing and base clamp onto the bag's edge. Annular upper and lower rubber-type seals 214 and 216 respectively surround the hole and create an inner vacuum chamber. Pump 208 communicates with the vacuum chamber via air hose 220 and when activated, evacuates the air from within the bag through the hole, the vacuum chamber and the hose. While the pump is still operating to maintain that vacuum condition, annular heating element 224 is energized to heat-seal the bag panels together in the area surrounding the hole and thereby isolate the food within the bag from the outside air until such time as the interlocking seal 222 is opened to access the food.

Annular back-up strip 226 supports the side of the bag opposite from the heating element during sealing.

Figure 17A:
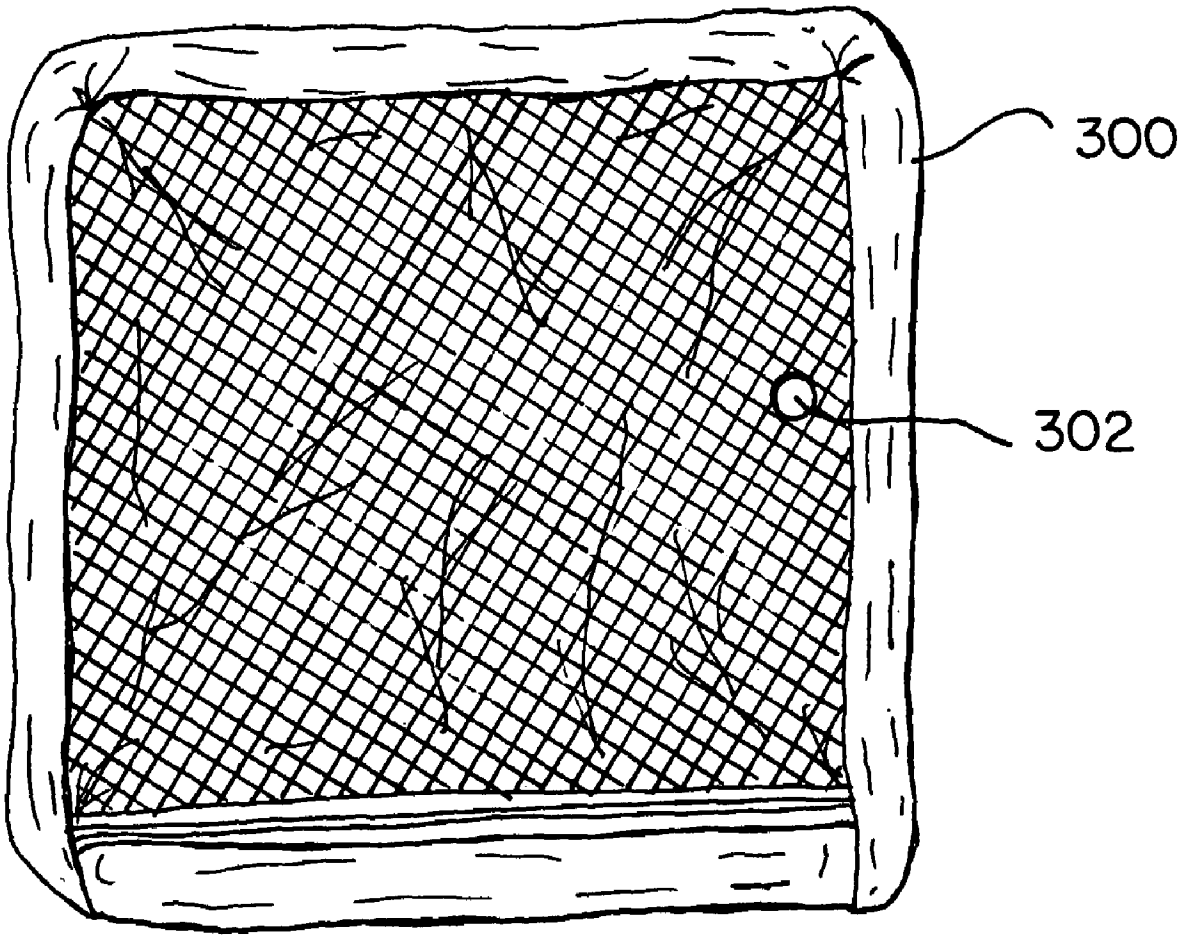
FIG. 17A is a top view of a bag having a hole punched there-through according to one of the preferred embodiments of the invention.
Figure 17B:
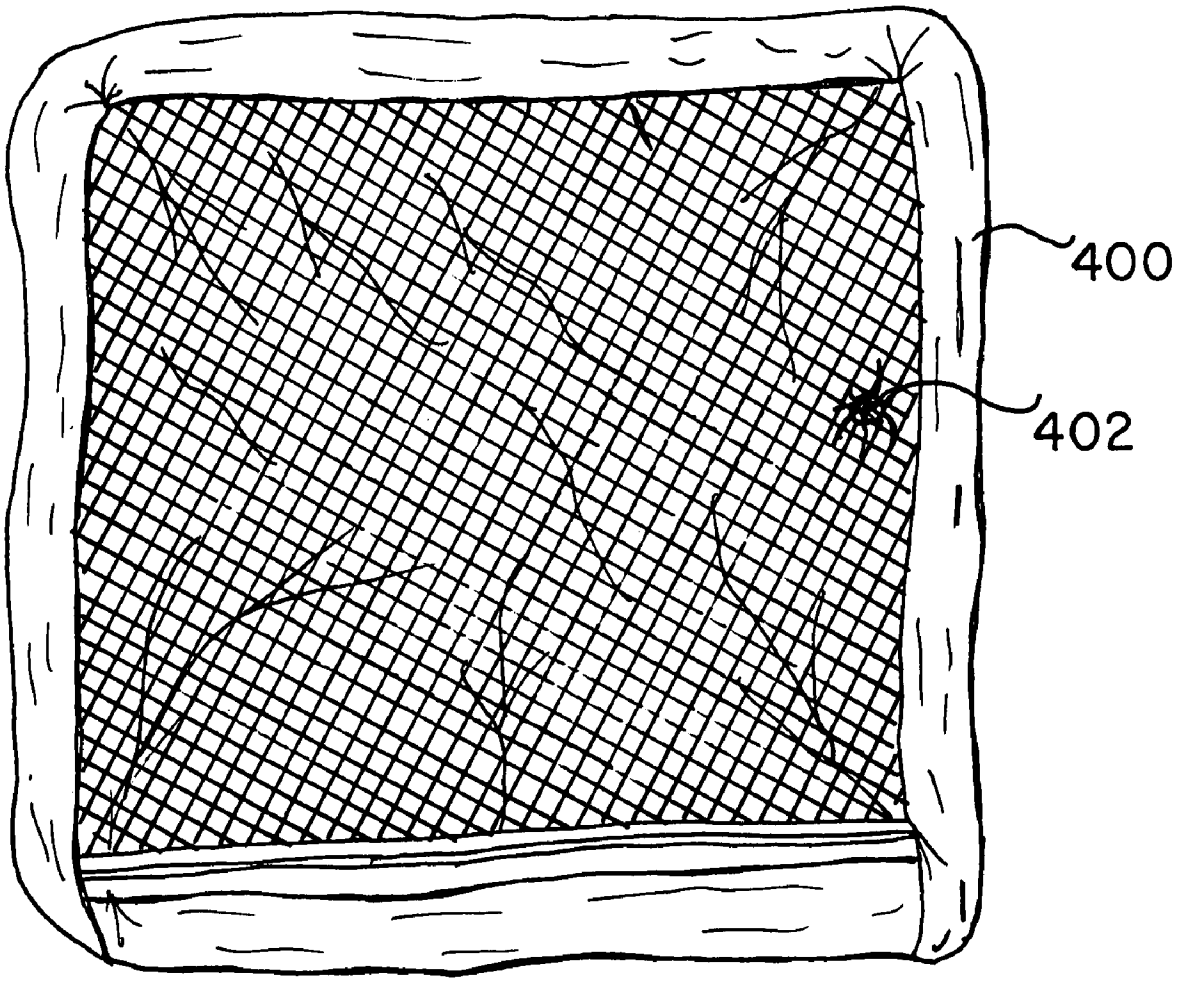
FIG. 17B is a top view of a bag having a hole pierced there-through according to one of the preferred embodiments of the invention.
Figure 17C:
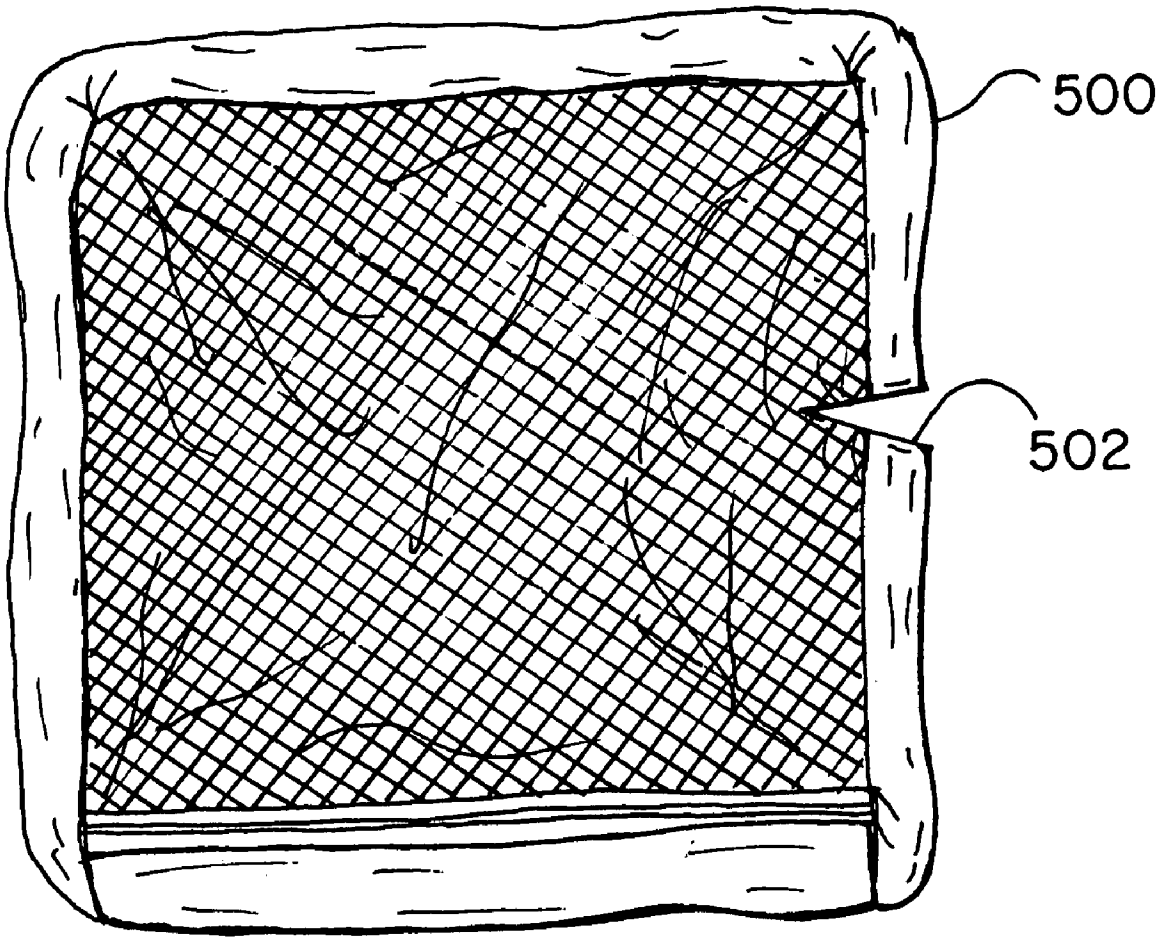
FIG. 17C is a top view of a bag having a notch punched there-through according to one of the preferred embodiments of the invention.

FIGS. 17A though 17C depict several of the infinite types and shapes of holes which may be pierced or punched through the bags of this invention, including a punched round hole 302 shown in bag 300 of FIG. 17A, a pierced star-shaped hole 402 shown in bag 400 of FIG. 17B, and punched notch 502 extending through the edge of the bag 500 of FIG. 17C. Of course, the size and shape of the hole may be varied in an almost infinite number of ways without departing from the scope of the invention.

Figure 18A:
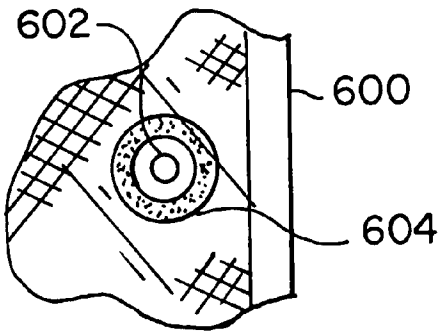
FIG. 18A is a partial view of a bag having a circular seal according to one of the preferred embodiments of the invention.
Figure 18B:
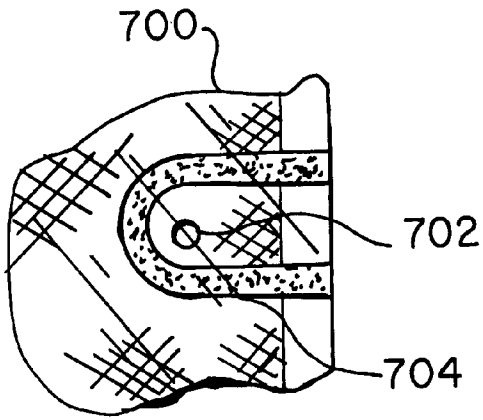
FIG. 18B is a partial view of a bag having a U-shaped seal according to one of the preferred embodiments of the invention.
Figure 18C:
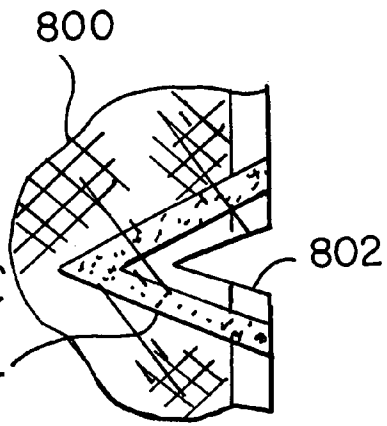
FIG. 18C is a partial view of a notched bag having a V-shaped seal according to one of the preferred embodiments of the invention.

FIGS. 18A though 18C depict several of the infinite types and shapes of heat-seals which may be applied around the holes that have been pierced or punched through the bags of this invention, including an annular seal 604 around the periphery of the hole 602 punched in bag 600 of FIG. 18A, a U-Shaped seal 704 partially around the hole 702 punched in bag 700 of FIG. 18B and extending to its edge, and a V-shaped seal 804 partially around the notch 802 punched in the edge of bag 800 of FIG. 18C and extending to its edge. Of course, the size and shape of the seal may be varied in an almost infinite number of ways without departing from the scope of the invention.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention, which should only be limited by the following claims.

We claim:

1. A method of preserving foodstuffs in a rectangular plastic bag of the type having two heat-sealable panels hermetically joined along three edges of their shared periphery, and having a temporarily interlocking linear hermetic seal along a fourth peripheral edge, said method comprising:

opening the fourth peripheral edge of the bag, placing the foodstuffs into the bag through the open fourth peripheral edge, interlocking the linear hermetic seal to thereby temporarily hermetically join the entire periphery of the two panels and form an inner chamber having the foodstuffs therein, and to isolate the foodstuffs within said inner chamber from the outer environment;

disposing first and second temporary covers over a position on the bag to be pierced and against the panels, to temporarily isolate said position from the outer environment, one of said first and second temporary covers comprising a vacuum source;

providing a piercing means for piercing the position on the bag, wherein said piercing means is operatively driven by a vacuum condition between said first and second temporary covers;

piercing the bag to form an opening passing through both panels and communicating with said inner chamber;

said vacuum source communicating with said opening such that said inner chamber is in isolated communication with said vacuum source; and activating said vacuum source to evacuate substantially all air from said inner chamber and permanently sealing both panels together fully about said opening once said inner chamber is evacuated, to isolate the foodstuffs within said evacuated inner chamber from the outer environment.

2. The method of claim 1 wherein said first and second temporary covers are biased together and against the panels.

3. The method of claim 2 wherein said step of permanently sealing both panels together fully about said opening comprises applying heat to said panels to melt both panels together.

4. The method of claim 1 wherein said step of permanently sealing both panels together fully about said opening comprises applying heat to said panels to melt both panels together.

5. The method of claim 1 wherein said step of activating said vacuum source comprises energizing an electrically operated vacuum pump.

6. The method of claim 1 wherein said step of permanently sealing both panels together fully about said opening comprises energizing an electric heating element.

7. The method of claim 6 wherein said step of activating said vacuum source comprises energizing an electrically operated vacuum pump.

8. A method of preserving foodstuffs in a rectangular plastic bag of the type having two heat-sealable panels hermetically joined along three edges of their shared periphery, and having a temporarily interlocking linear hermetic seal along a fourth peripheral-edge, said method comprising:

opening the fourth peripheral edge of the bag, placing the foodstuffs into the bag through the open fourth peripheral edge, interlocking the linear hermetic seal to thereby temporarily hermetically join the entire periphery of the two panels and form an inner chamber having the foodstuffs therein, and to isolate the foodstuffs within said inner chamber from the outer environment;

providing a piercing means for piercing the bag, piercing the bag to form an opening passing through both panels and communicating with said inner chamber, said opening having a first end at one of the panels and a second end at the other of the panels, disposing first and second temporary covers over said first and second ends, respectively, and against the panels, to temporarily isolate said first and second ends from the outer environment and prevent air from entering said inner chamber from the outer environment through said opening, wherein said piercing means is operatively driven by a vacuum condition between said first and second temporary covers, and one of said first and second temporary covers comprising a vacuum source, said vacuum source communicating with said opening such that said inner chamber is in isolated communication with said vacuum source; and activating said vacuum source to evacuate substantially all air from said inner chamber and permanently sealing both panels together about opening once said inner chamber is evacuated, to isolate the foodstuffs within said evacuated inner chamber from said opening and from the outer environment.

9. The method of claim 8 wherein said first and second temporary covers are biased together over said first and second ends, respectively, and against the panels.

10. The method of claim 9 wherein said step of permanently sealing both panels together fully about said opening comprises applying heat to said panels to melt both panels together.

11. The method of claim 8 wherein said step of permanently sealing both panels together fully about said opening comprises applying heat to said panels to melt both panels together.

12. The method of claim 8 wherein said step of activating said vacuum source comprises energizing an electrically operated vacuum pump.

13. The method of claim 8 wherein said step of permanently sealing both panels together fully about said opening comprises energizing an electric heating element.

14. The method of claim 13 wherein said step of activating said vacuum source comprises energizing an electrically operated vacuum pump.

15. A method of preserving foodstuffs in a rectangular plastic bag of the type having two heat-sealable panels hermetically joined along three edges of their shared periphery, and having a temporarily interlocking linear hermetic seal along a fourth peripheral edge, said method comprising:

opening the fourth peripheral edge of the bag, placing the foodstuffs into the bag through the open fourth peripheral edge, interlocking the linear hermetic seal to thereby temporarily hermetically join the entire periphery of the two panels and form an inner chamber having the foodstuffs therein, and to isolate the foodstuffs within said inner chamber from the outer environment;

piercing the bag with a spring-biased piercing means operatively driven by a flexible diaphragm to form an opening passing through both panels and communicating with said inner chamber, said opening having a first end at one of the panels and a second end at the other of the panels, temporarily isolating said first and second ends from the outer environment, while placing one of said first and second ends in pneumatic engagement with a vacuum source such that said inner chamber is in isolated pneumatic communication with said vacuum source and wherein said flexible diaphragm is operatively driven by a vacuum condition present between said first and second ends while temporarily isolated from the outer environment; and activating said vacuum source to evacuate substantially all air from said inner chamber and permanently sealing both panels together fully about said opening once said inner chamber is evacuated, to isolate the foodstuffs within said evacuated inner chamber from the outer environment.

16. The method of claim 15 wherein said step of activating said vacuum source comprises energizing an electrically operated vacuum pump.

17. The method of claim 15 wherein said step of permanently sealing both panels together fully about said opening comprises energizing an electric heating element.

18. The method of claim 17 wherein said step of activating said vacuum source comprises energizing an electrically operated vacuum pump.

19. A method of preserving foodstuffs in a rectangular plastic bag of the type having two heat-sealable panels hermetically joined along three edges of their shared periphery, and having a temporarily interlocking linear hermetic seal along a fourth peripheral edge, said method comprising:

opening the fourth peripheral edge of the bag, placing the foodstuffs into the bag through the open fourth peripheral edge, interlocking the linear hermetic seal to thereby temporarily hermetically join the entire periphery of the two panels and form an inner chamber having the foodstuffs therein, and to isolate the foodstuffs within said inner chamber from the outer environment;

providing a piercing means;

locating a position on the bag to be pierced;

temporarily isolating said position from the outer environment activating a vacuum source to operatively engage said piercing means with said bag at the position;

piercing the bag to form an opening passing through both panels and communicating with said inner chamber, said opening having a first end at one of the panels and a second end at the other of the panels; and evacuating substantially all air from said inner chamber and permanently sealing both panels together about said opening once said inner chamber is evacuated, to isolate the foodstuffs within said evacuated inner chamber from said opening and from the outer environment.

20. The method of claim 19 wherein said step of activating said vacuum source comprises energizing an electrically operated vacuum pump.

21. The method of claim 20 wherein said step of permanently sealing both panels together fully about said opening comprises energizing an electric heating element.

22. The method of claim 21 wherein said step of activating said vacuum source comprises energizing an electrically operated vacuum pump.

* * * * *